US006048297A

United States Patent [19]

Lange et al.

[11] Patent Number: 6,048,297

[45] **Date of Patent: *Apr. 11, 2000**

[54] GRIPPER CYLINDER IN A FOLDING APPARATUS

[75] Inventors: Klaus-Ulrich Lange, Gersthofen; Friedrich Michaelis, Augsburg; Hermann Lenz, Königsbrunn, all of Germany

[73] Assignee: MAN Roland Druckmaschinen AG, Offenbach am Main, Germany

[ * ] Notice: Under 35 U.S.C. 154(b), the term of this patent shall be extended for 479 days.

[21] Appl. No.: 08/499,111

[22] Filed: Jul. 6, 1995

[30] Foreign Application Priority Data

Jul. 9, 1994 [DE] Germany ..... 94 11 121 U

[51] Int. Cl.[7] ..... B65H 5/12

[52] U.S. Cl. ..... 493/424; 271/277; 271/82; 493/475

[58] Field of Search ..... 493/424, 425, 493/426, 427, 428, 429, 430, 431, 432, 433, 478, 356, 357, 359, 418, 475; 271/82, 206, 277, 275

[56] References Cited

U.S. PATENT DOCUMENTS

| | | | |
|---|---|---|---|
| 3,680,642 | 8/1972 | Kirn et al. | 173/48 X |
| 4,667,952 | 5/1987 | Jeschke et al. | 271/277 |
| 5,447,205 | 9/1995 | Thurler | 173/48 |
| 5,465,663 | 11/1995 | Bayer et al. . | |

FOREIGN PATENT DOCUMENTS

| | | |
|---|---|---|
| 0170111 | 2/1986 | European Pat. Off. . |
| 0652105 | 5/1995 | European Pat. Off. . |
| 2322078 | 3/1977 | France . |
| 2011737 | 7/1971 | Germany . |
| 61-0863368 | 1/1986 | Japan . |

*Primary Examiner*—David A. Scherbel
*Assistant Examiner*—Anthony Ojini
*Attorney, Agent, or Firm*—Cohen, Pontani, Lieberman & Pavane

[57] ABSTRACT

A gripper cylinder for a folding apparatus, the gripper cylinder having a cylinder shaft on which a cylinder body is mounted and at least two gripper stations mounted to the cylinder body. The gripper stations include grippers and corresponding gripper bases. An adjustment mechanism is provided for adjusting the distance between each gripper and its corresponding gripper base to correspond to the thickness of a product to be gripped. The gripper mechanism is operative to simultaneously adjust all of the gripper stations.

15 Claims, 10 Drawing Sheets

GRIPPER CYLINDER IN A FOLDING APPARATUS

BACKGROUND OF THE INVENTION

1. Field of the Invention

The invention relates to a gripper cylinder for a folding apparatus with adjusting means for adjusting the distance between the grippers and the gripper bases corresponding to the thickness of the products to be gripped.

2. Description of the Prior Art

A gripper cylinder is part of a folding apparatus for cutting and folding a paper web and is known, e.g., from EP 0 531 648 A1. The folding apparatus described in this reference has a gripper cylinder and folding blade cylinder. In order to grip products of different thickness with a gripper cylinder of this type, the springing action of the gripper must be utilized. Sometimes, it is also attempted to adjust the supports with which the grippers cooperate, i.e. the gripper bases, individually at every gripping station. Further, the grippers are also adjusted individually for different product thicknesses by means of adjusting screws. This construction, however, has the disadvantage of being rather costly. Also, under certain circumstances, marks may appear on the products when spring-loaded grippers press too heavily against the paper.

SUMMARY OF THE INVENTION

Accordingly, it is an object of the present innovation to improve a gripper cylinder so that the distances between the grippers and the gripper bases are adapted to the product thickness in a simple manner so that products can be transported further without damage or marks regardless of their thickness.

Pursuant to this object, and others which will become apparent hereafter, one aspect of the present invention resides in a gripper cylinder having a cylinder body mounted on a cylinder shaft. At least two gripper stations are mounted on the cylinder body and include grippers with corresponding gripper bases. Adjusting means are provided for adjusting the distance between each gripper and its corresponding gripper base so that the distance corresponds to the thickness of the product to be gripped. The adjusting means is operative to simultaneously adjust all the gripper stations.

Pursuant to a further embodiment of the invention the adjusting means is operative to adjust the gripper bases.

In still another embodiment the gripper bases are formed by rollers which have a periphery formed by a plurality of surfaces at different distances from the center of the roller. It is also possible for the rollers to be supported eccentrically on the cylinder body. The outer surface of the rollers can also have a non-circular cross-section, such as an elliptical cross-section.

Still an additional embodiment of the invention has means for moving the gripper disks. The moving means includes a rotatable disk provided on at least one end of the cylinder body, which disk is rotatable by helical gear wheels. The rotation of the disk causes the rollers which form the gripper bases to rotate.

In yet another embodiment the disk can be adjusted manually by utilizing a threaded spindle which is connected to the disk and further connected to a member fixed to the shaft of the cylinder. Thus, rotation of the spindle causes the disk to be moved relative to the fixed member.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
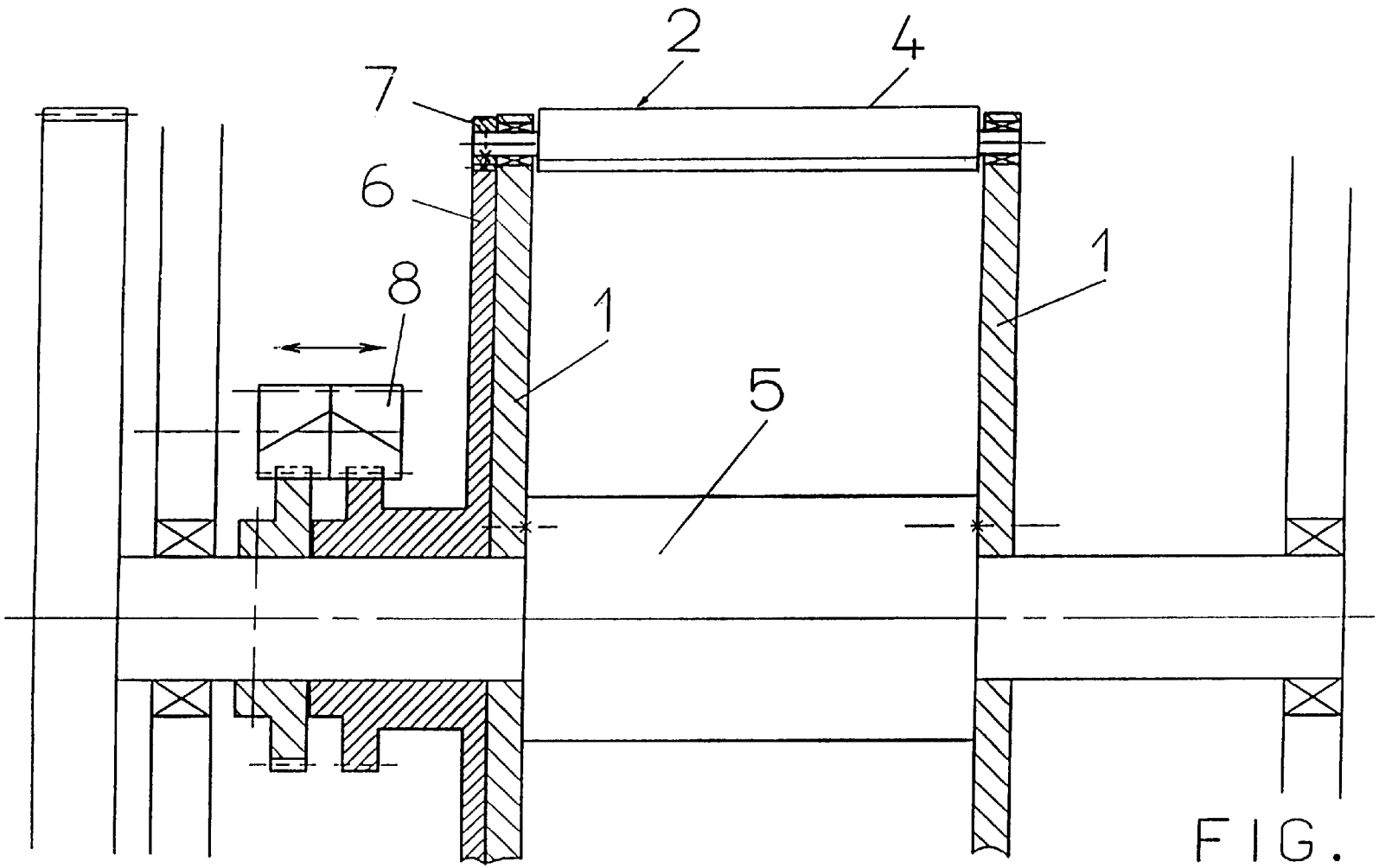
FIG. 1 shows a gripper cylinder pursuant to the present invention in longitudinal section.

As shown in FIG. 1, a gripper cylinder has a cylinder body 1 as a support or base for gripper stations 2, the illustrated gripper cylinder having three gripper stations, for example. When the gripper cylinder is constructed as a gripper cylinder and folding-blade cylinder, it also has another cylinder body which supports the folding blades. Each gripper station 2 has one or more grippers 3 (compare FIG. 2*a*) which press the products against the gripper base. In a first embodiment of the invention, the gripper bases are constructed as rotatably supported rollers 4 (FIG. 1, 2*a–c*). Every roller 4 has, at its circumference, surfaces 40, 41, 42, . . . (FIGS. 2*a–c*) at different distances from the center axis of the roller 4. A different one of the surfaces 40, 41, 42, . . . can be selected by rotating the roller 4. Accordingly, the distance between the surface 40, 41, 42, . . . and the gripper 3 can be suitably adapted to the product thickness.

The rollers 4 are rotated by means of a disk 6 which is arranged on the cylinder shaft 5 (FIG. 1) so as to be rotatable. The disk 6 is connected with an element 7 which is arranged on the roller 4 in a stationary manner. This element 7 and the disk 6 are preferably constructed as toothed wheels. The disk 6 itself is adjusted relative to the cylinder body 1 and the shaft 5 by means of opposed helical toothed gear wheels 8.

Figure 2A:
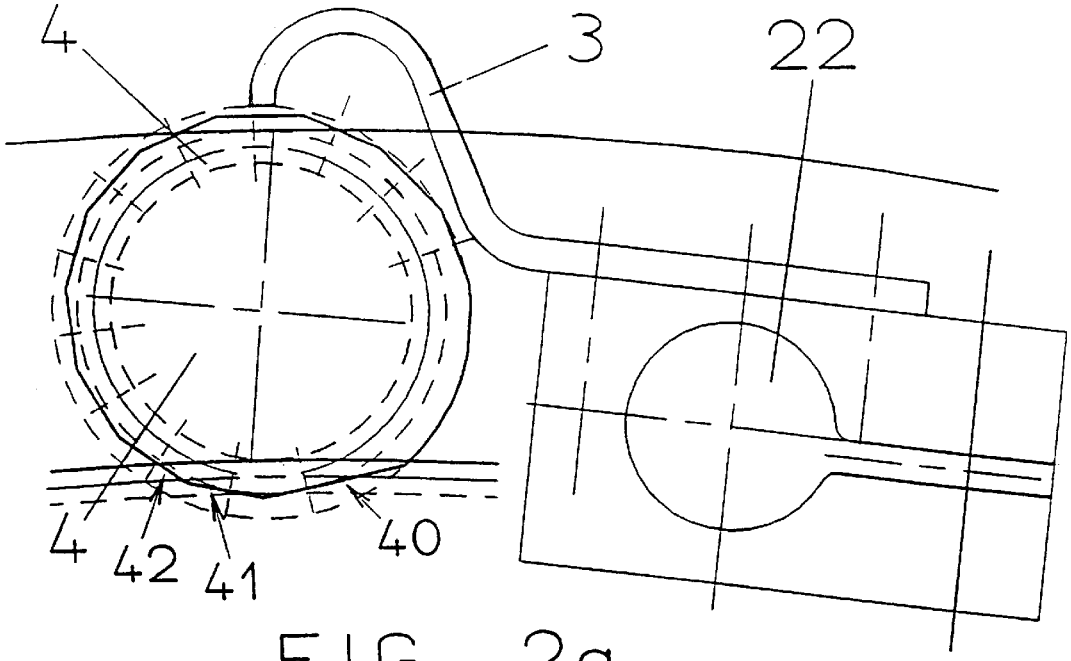
FIGS. 2*a* to 2*c* show a gripper station with gripper bases in cross section.
Figure 2B:
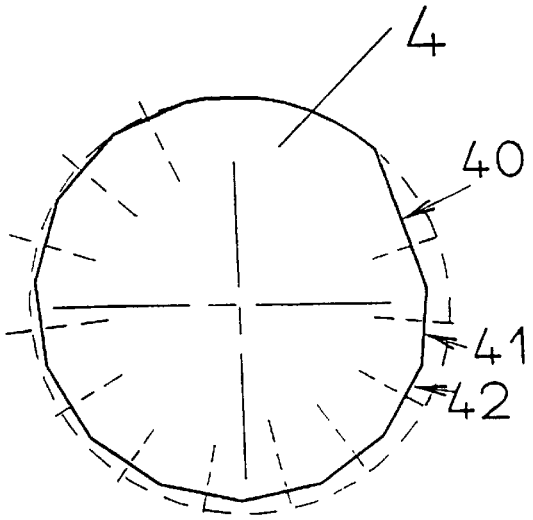
Figure 2C:
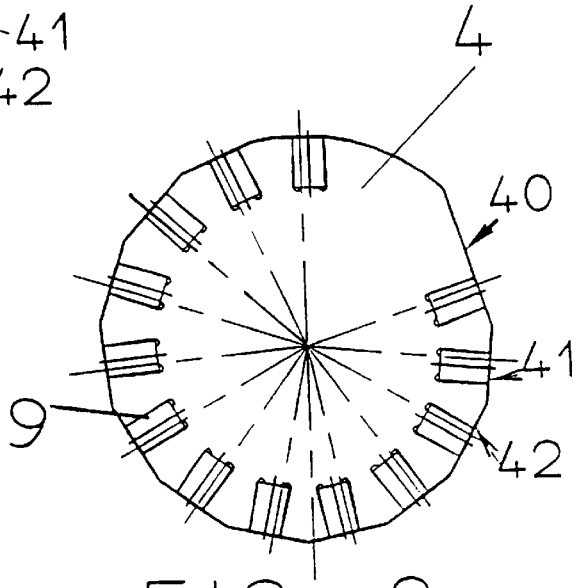

Instead of individual surfaces 40, 41, 42, . . . , the roller 4 can also have a continuous surface with an elliptical cross section or an eccentrically supported surface with a circular cross section. The roller 4 as shown in FIG. 2*c* also advantageously has resilient, e.g., rubber, inserts 9 on its surfaces 40, 41, 42, . . . or on its continuous surface.

Figure 3:
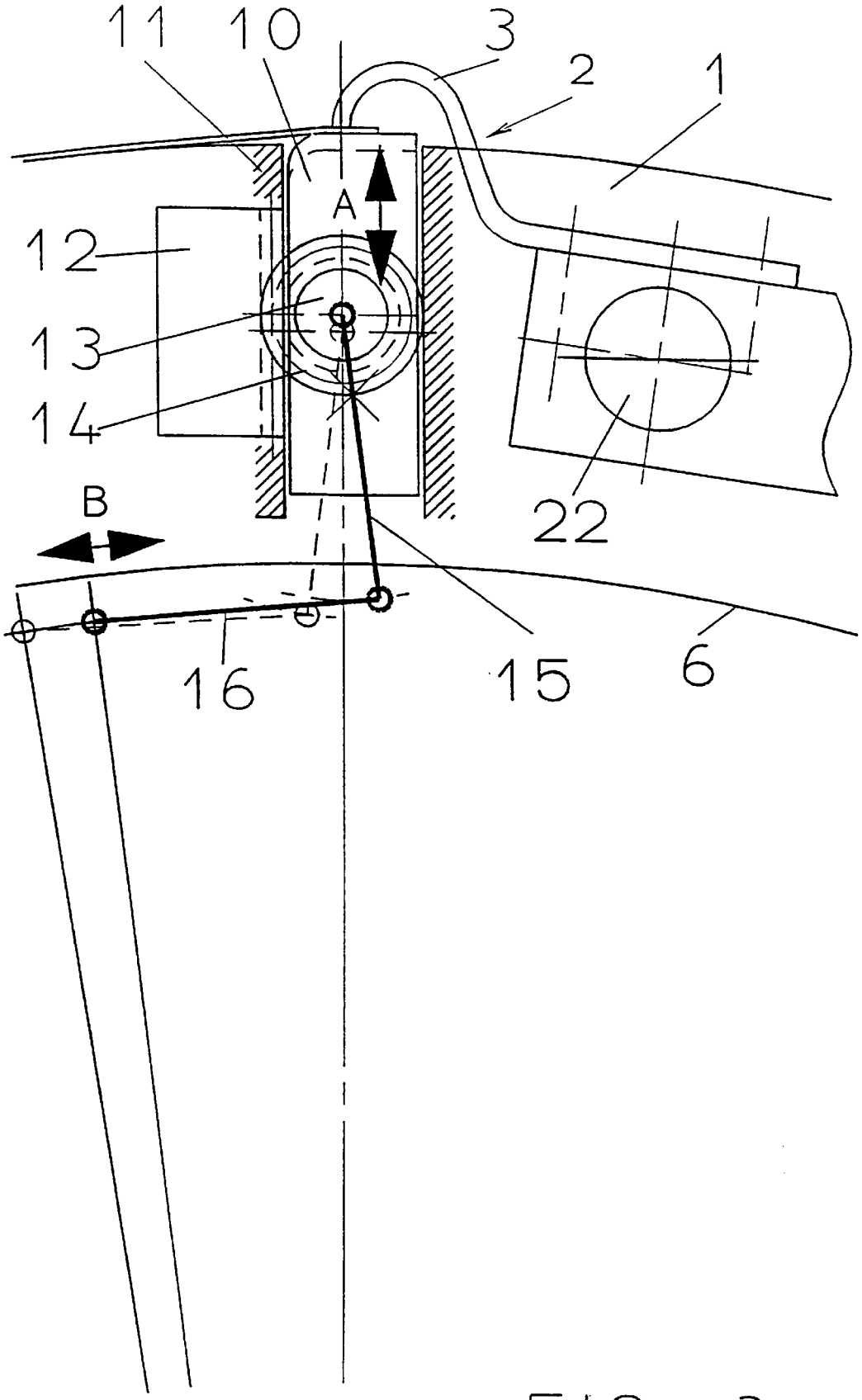
FIG. 3 shows a top view of another gripper station at one end of the gripper cylinder.
Figure 4:
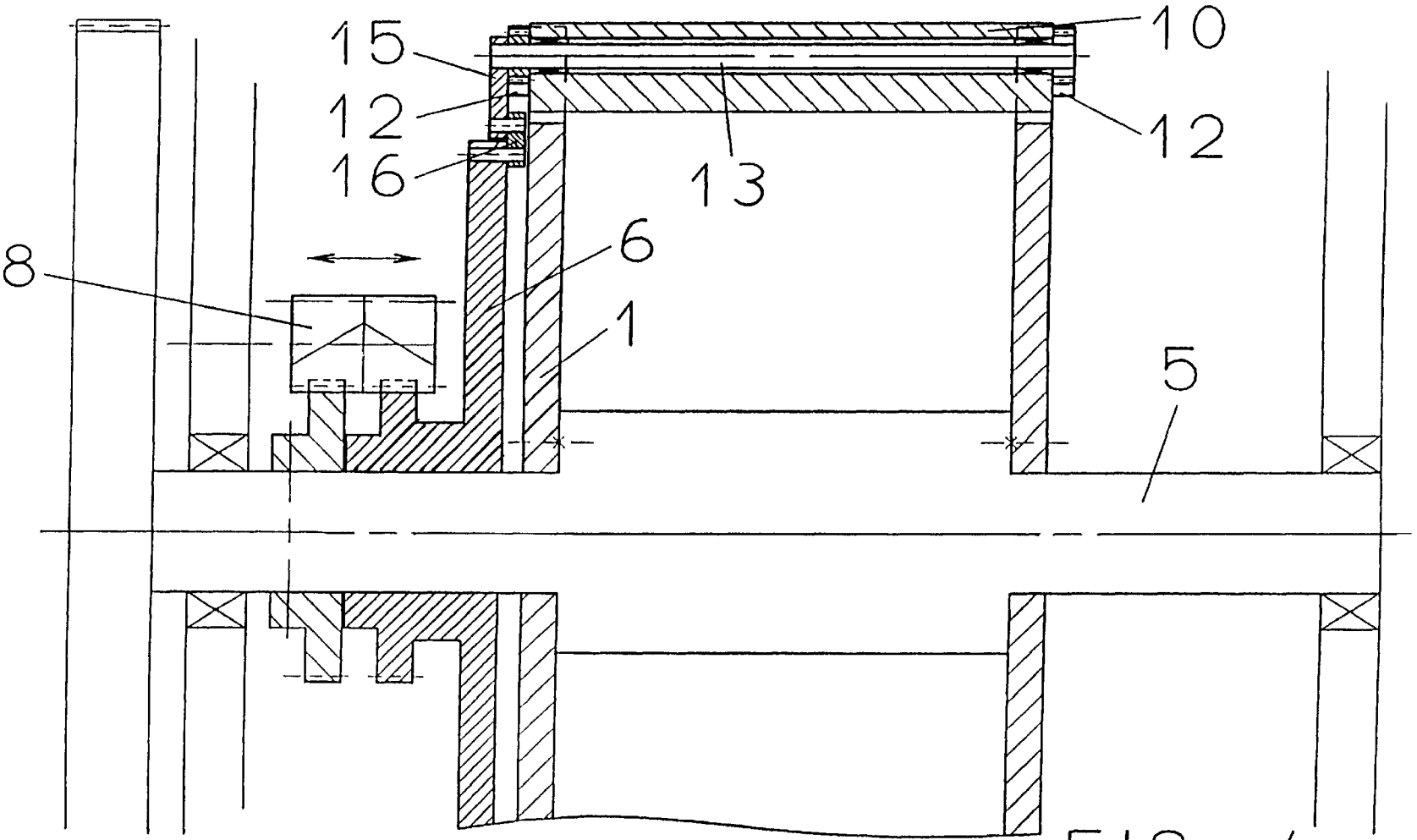
FIG. 4 shows the gripper cylinder according to FIG. 3 in longitudinal section.

In another embodiment of the invention, continuously adjustable gripper bases 10 (FIGS. 3, 4) constructed as blocks are provided instead of the rollers 4. This gripper base 10 is arranged in a slide guide or straight-edge guide 11 that extends radially to the center of the cylinder. Toothed segments 12 are arranged at the end sides of the cylinder body 1 for adjusting the gripper base 10 in the direction of arrow A. These toothed segments 12 mesh with toothed wheels 14 arranged at both sides on a shaft 13 supported in the interior of the gripper base 10. One of the toothed wheels 14 is connected with a lever 15 in a stationary manner on one end of the cylinder. This lever 15 is in turn articulated at a movable lever 16. The lever 16 is movably connected with the disk 6 which is arranged so as to be rotatable on the cylinder shaft 5. The levers 15, 16 and accordingly the toothed wheel 14 are adjusted by rotating the disk 6 in the direction of arrow B.

Figure 5:
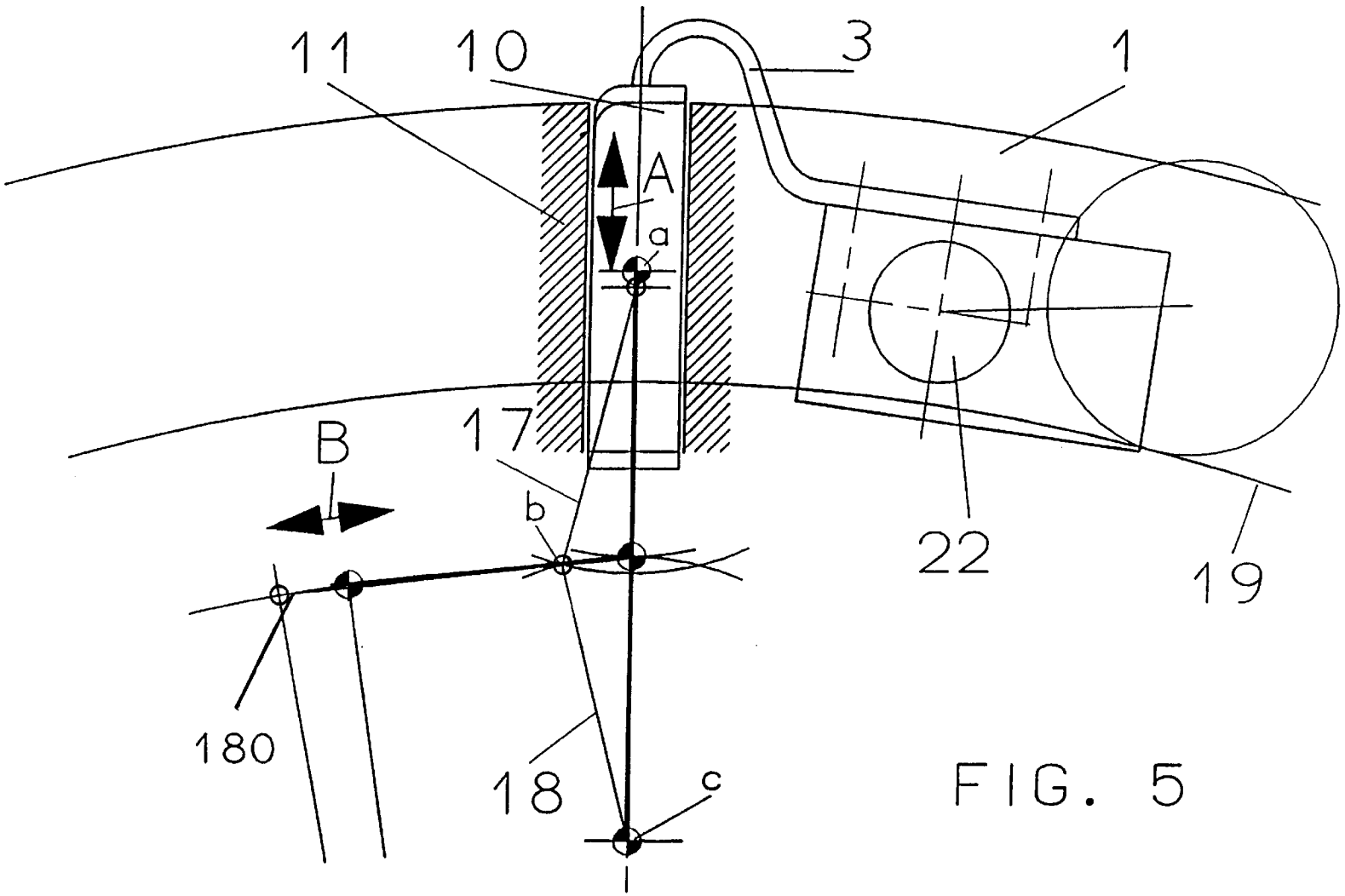
FIG. 5 shows a top view of another embodiment of a gripper station at one end of the gripper cylinder.
Figure 6:
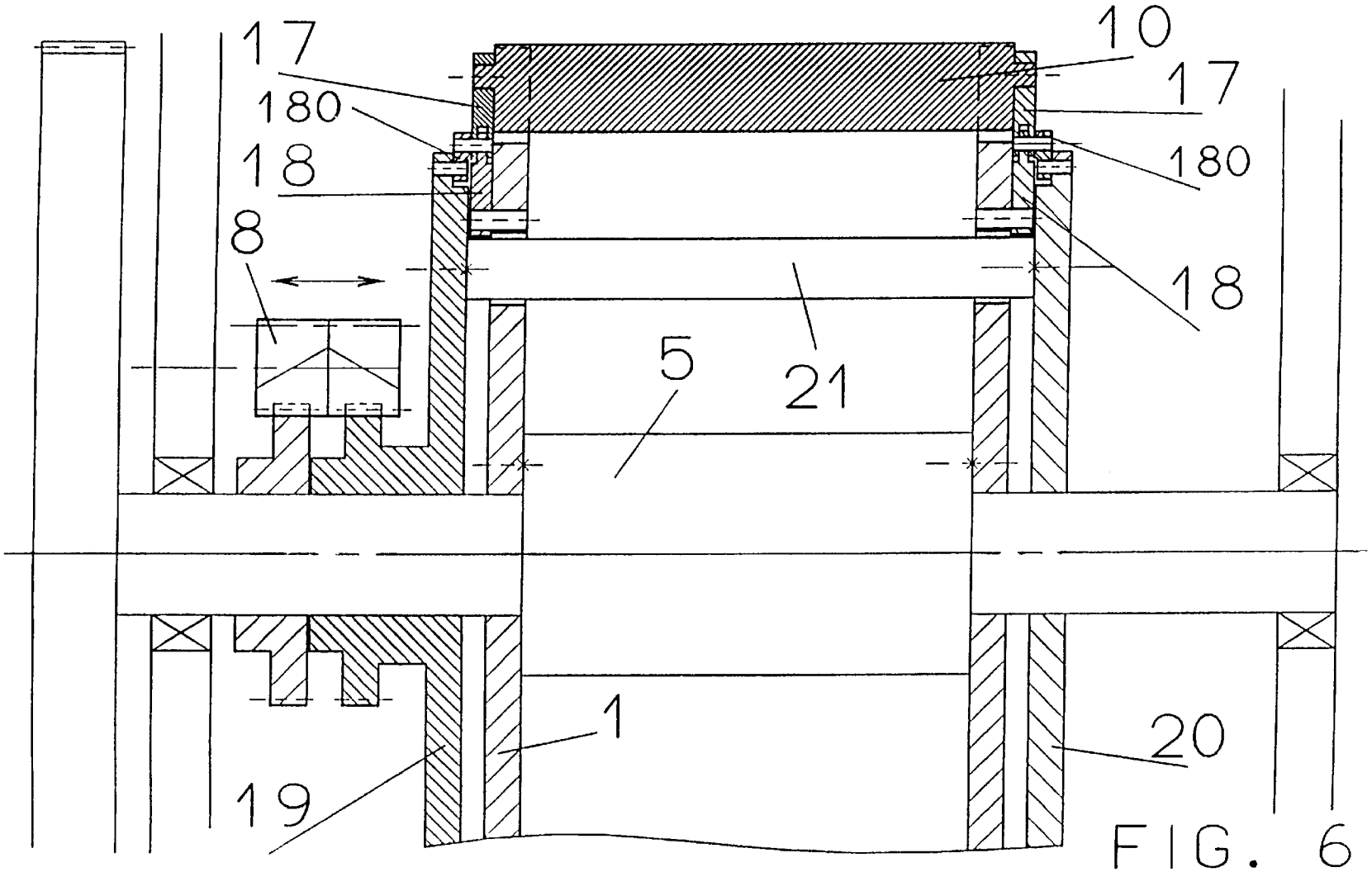
FIG. 6 shows a gripper cylinder in longitudinal section.
Figure 7:
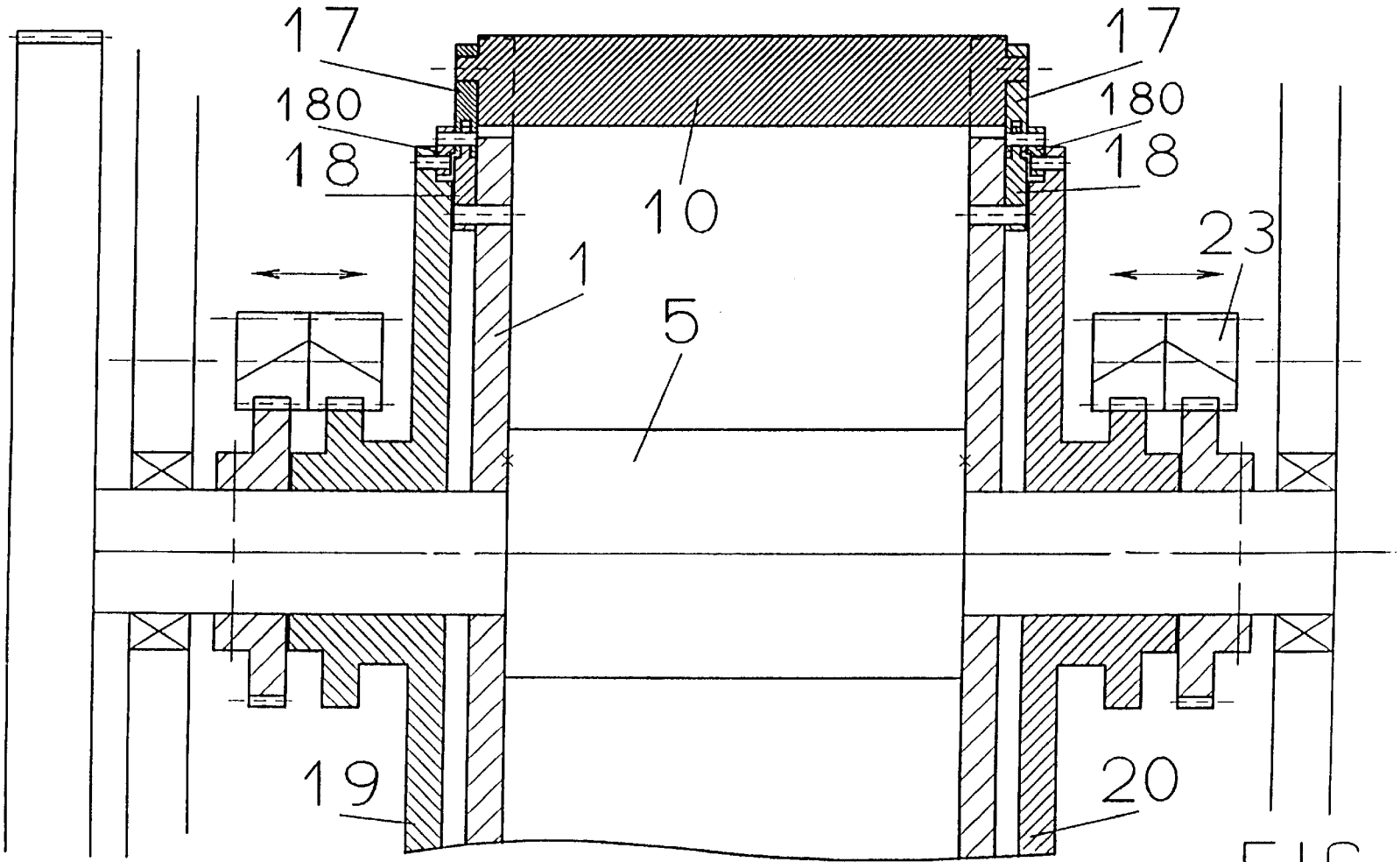
FIG. 7 shows another embodiment of a gripper cylinder in longitudinal section.

In a further embodiment of the invention, the gripper base 10 (FIG. 5) is supported in the straight-edge guide 11 at the end sides of the gripper cylinder respectively via two levers 17, 18 at articulation points a, b, c. The levers 17, 18 are connected with another lever 180 at articulation point b, this lever 180 being movably connected with a disk 19 or 20 (FIG. 6) which is rotatably arranged on the cylinder shaft 5. The disks 19, 20 are either rigidly connected with one another via a connecting member 21 so that the rotating movement transmitted via the helical toothed wheels 8 is adjusted parallel to the axis, or the disks 19, 20 (FIG. 7) are adjustable separately, e.g., via opposed helical toothed gear wheels 8'. This enables an additional one-sided adjustment which is especially necessary when the products to be gripped have different thicknesses at the two end sides, e.g., as a result of a folded spine.

Figure 8:
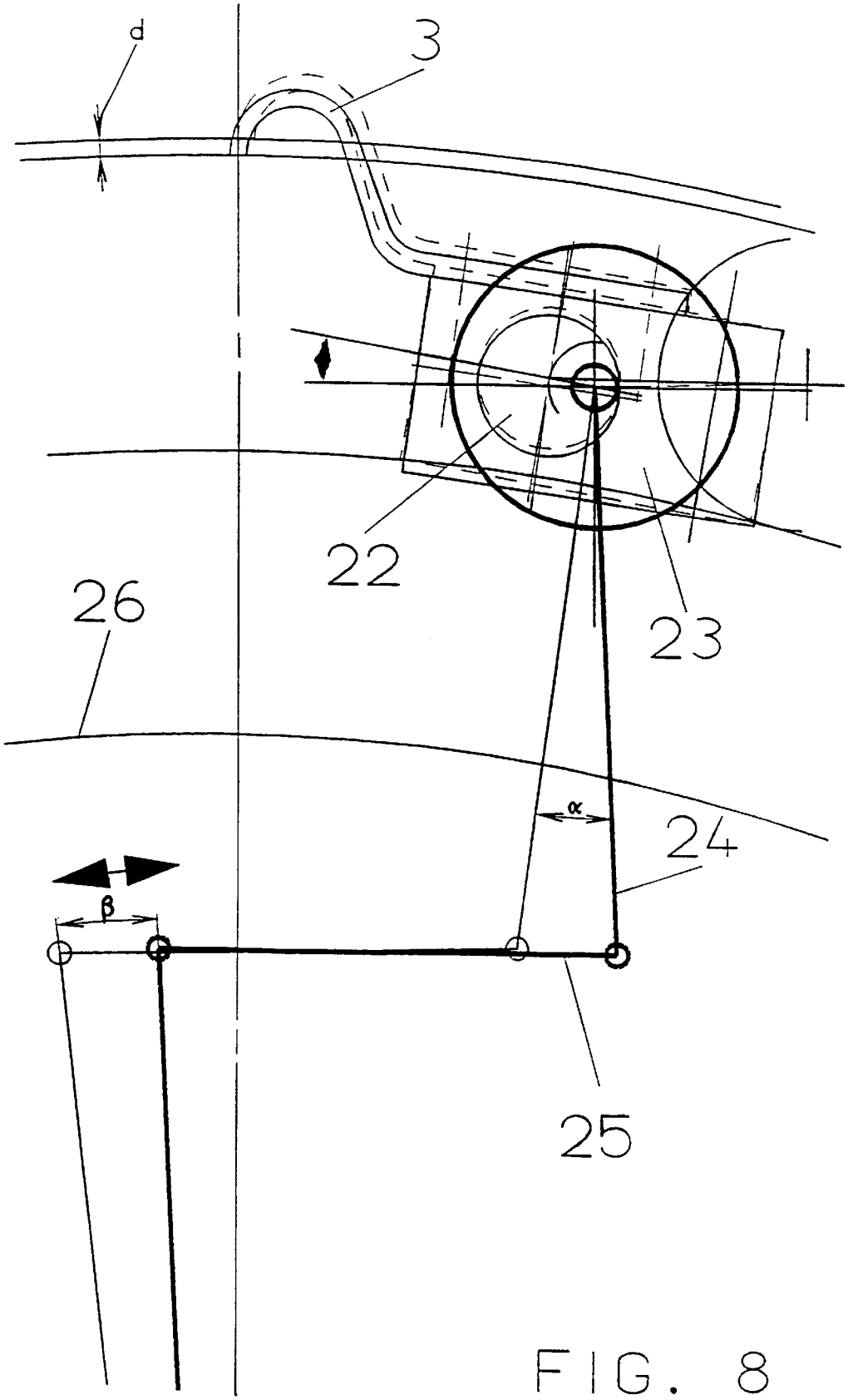
FIG. 8 shows a top view of a further gripper station at one end of the gripper cylinder.
Figure 9:
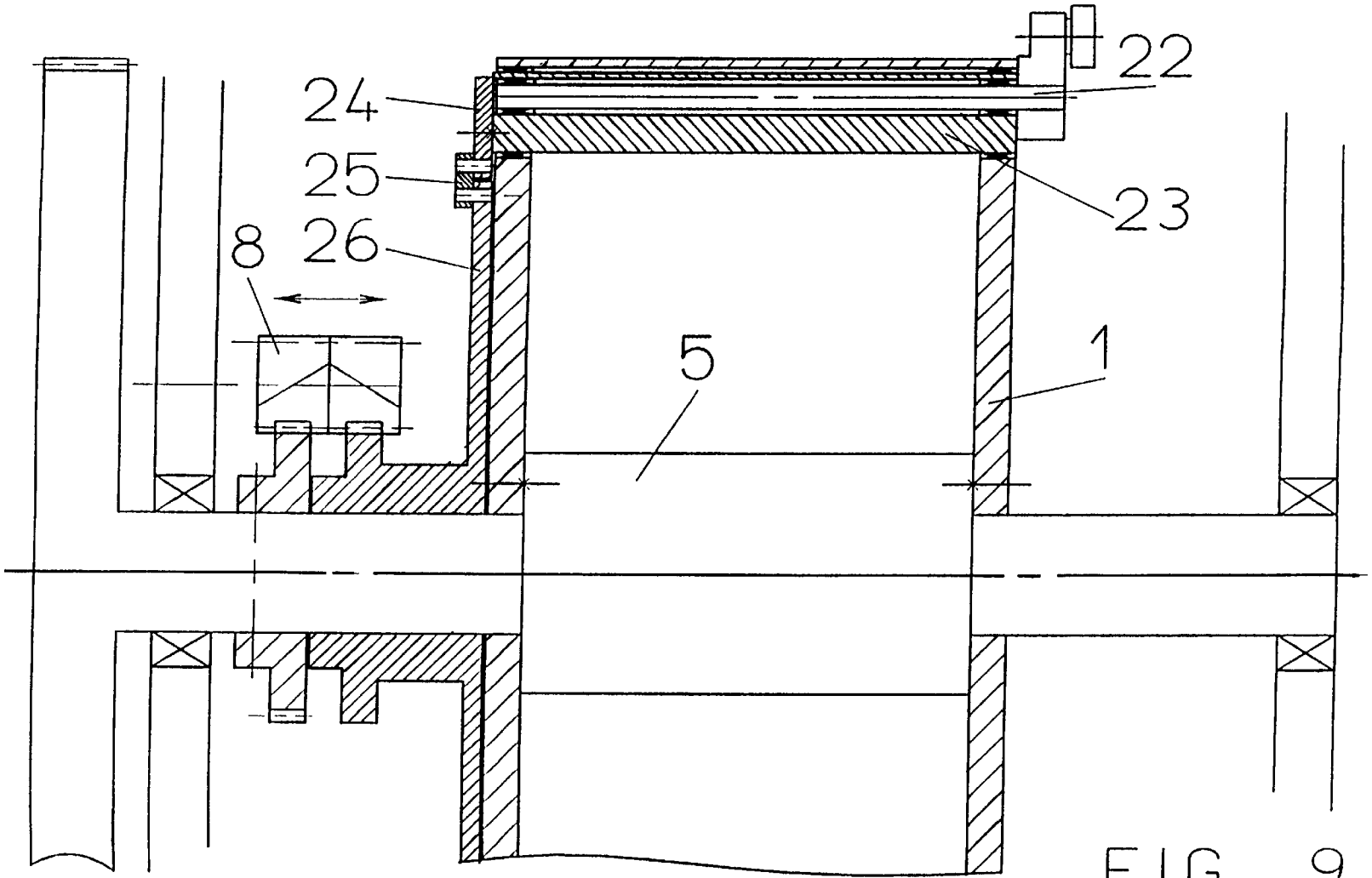
FIG. 9 shows a further gripper cylinder in longitudinal section.

Instead of adjusting a roller 4 which serves as gripper base 10 or adjusting the gripper base 10, it is also possible to adjust the grippers 3 either by themselves or in combination with the rollers 4 or the gripper bases 10 so as to adapt their spacing to the products. For this purpose, the grippers 3, together with the gripper spindle 22 (FIG. 8) to which they are fastened, are rotatably supported in a support 23 in an eccentric manner. A lever 24 is secured to the support 23 at one side of the cylinder. Another lever 25 is rotatably supported at the lever 24, and is secured to a disk 26 (FIG. 9) which is rotatably supported on the cylinder shaft 5. The disk 26 is adjusted in turn by means of the toothed wheels 8, e.g., by an angle β (FIG. 8). This enables a maximum adjustment of the position of the gripper 3 by a distance d.

Figure 10:
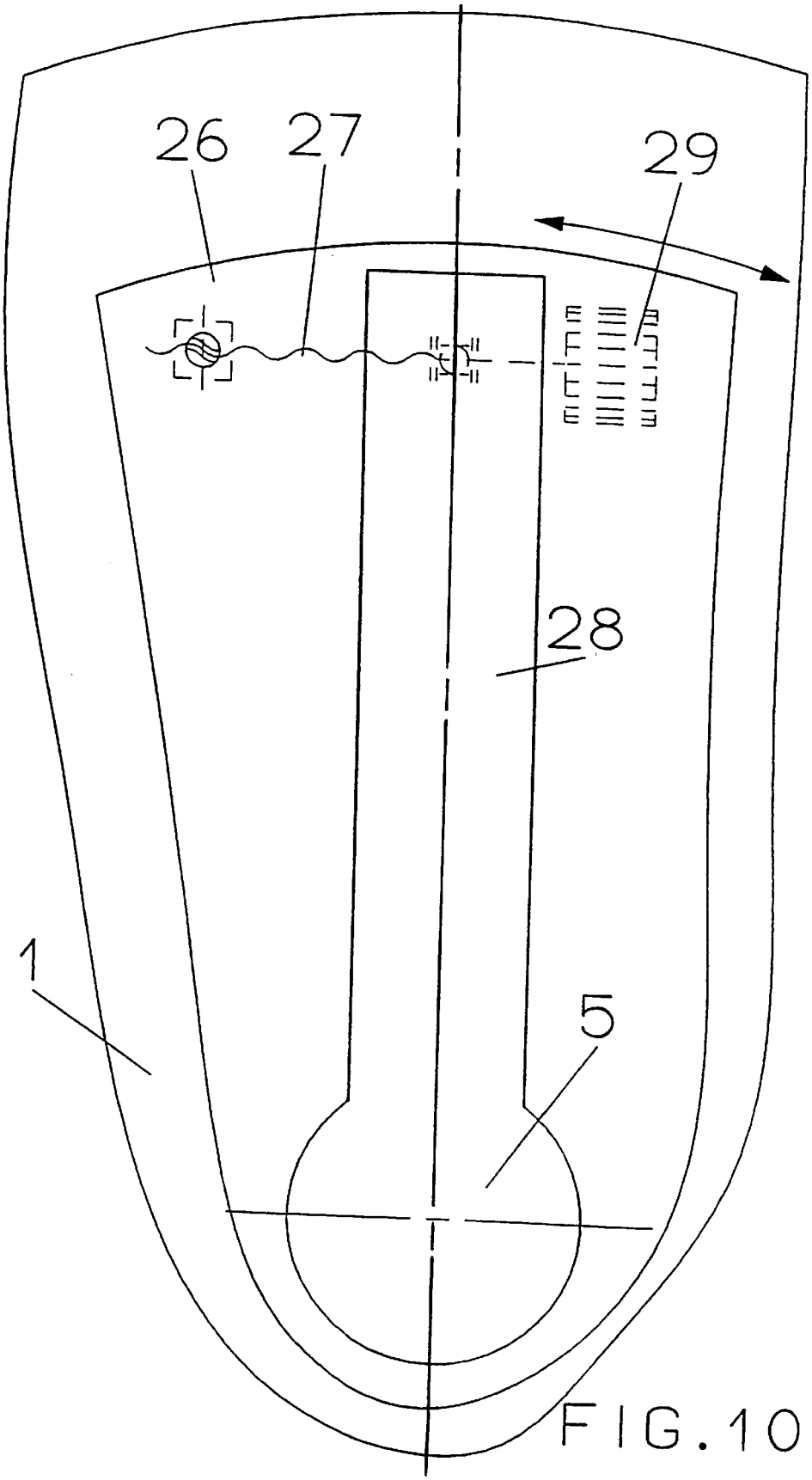
FIG. 10 shows a central manual adjustment for all gripper stations of a cylinder.

As is shown in FIG. 10 with reference to the disk 26, the disk 6, 19 or 26 can also be adjusted manually relative to the cylinder shaft 5 by means of a threaded spindle 27 which is rotatably arranged in the disk 26 and a segment 28 which is arranged on the cylinder shaft 5 in a stationary manner. The adjustment of the disk 26 is effected by rotating the threaded spindle 27 at a handle 29.

As a result of the invention, the distances between the grippers 3 and the gripper bases 10 can be adjusted centrally at the gripper stations 2 of a gripper cylinder in that the gripper bases 10 are adjusted in a radial direction via levers 15 to 18 and a disk 19, 26 arranged laterally to the cylinder and by means of the opposed helical toothed wheels 8. Otherwise, the grippers 3 are adjusted via an eccentric bearing 22, 23.

The invention is not limited by the embodiments described above which are presented as examples only but can be modified in various ways within the scope of protection defined by the appended patent claims.

We claim:

1. A gripper cylinder for a folding apparatus, comprising:

a cylinder shaft;

a cylinder body mounted on the cylinder shaft;

at least two gripper stations mounted on the cylinder body and including grippers and corresponding gripper bases, each of the gripper bases being configured as a roller having a periphery formed of a plurality of surfaces at different distances from a center of the roller; and adjusting means for adjusting the gripper stations so that a distance between each gripper and its corresponding gripper base corresponds to a thickness of a product to be gripped, the adjusting means being operative to simultaneously adjust all the gripper stations, the adjusting means further being operative to adjust the gripper bases.

2. A gripper cylinder according to claim 1, wherein each of the gripper bases is a roller which is supported eccentrically on the cylinder body.

3. A gripper cylinder according to claim 1, wherein each of the gripper bases is a roller which has a non-circular cross section.

4. A gripper cylinder according to claim 3, wherein the cross section of the roller is elliptical.

5. A gripper cylinder according to claim 1, wherein each of the gripper bases is a slidable block, the cylinder body having end sides with straight-edge guides formed therein, each slidable block being movably arranged in one of the straight-edge guides, the adjusting means including lever means for moving the slidable blocks in the straight-edge guides.

6. A gripper cylinder according to claim 5, wherein the lever means includes a disk rotatably mounted on the cylinder shaft at one end side of the cylinder body, a first lever having a first end pivotally connected to the disk, and a second lever having a first end connected to a second end of the first lever and a second end connected to the slidable block, whereby rotation of the disk causes the first and second levers to impart sliding movement to the block.

7. A gripper cylinder according to claim 1, wherein the adjusting means includes a disk rotatably arranged on the cylinder shaft at one end side of the cylinder body, and opposed helical gear wheels respectively arranged on the disk and the cylinder shaft, the disk being in operative connection with the gripper bases so that rotation of the disk causes movement of the gripper bases.

8. A gripper cylinder according to claim 7, wherein the adjusting means further includes a toothed wheel fixed to each gripper base so that each toothed wheel engages with the disk.

9. A gripper cylinder according to claim 1, wherein the adjusting means includes two disks arranged respectively at end sides of the cylinder body, a connecting member that interconnects the disks, and a pair of opposed helical toothed wheels respectively arranged on the cylinder shaft and one of the disks, the disks being operatively connected to the gripper bases so that rotation of the disks moves the gripper bases.

10. A gripper cylinder according to claim 1, wherein the adjusting means includes two disks rotatably mounted on the cylinder shaft respectively at end sides of the cylinder body, and two pairs of opposed helical gear wheels, each pair of gear wheels having one wheel arranged on the cylinder shaft and another wheel arranged on one of the disks, the disks being operatively connected to the gripper bases so that rotation of the disks moves the gripper bases.

11. A gripper cylinder according to claim 1, wherein the grippers are eccentrically supported on the cylinder body, and further comprising lever means for adjusting the grippers.

12. A gripper cylinder according to claim 11, wherein the lever means includes a disk rotatably mounted on the cylinder shaft at one end of the cylinder body, a first lever having a first end connected to the disk, and a second lever having a first end connected to a second end of the first lever and a second end connected to a gripper, whereby rotational movement of the disks imparts radial movement to the gripper, relative to the cylinder body.

13. A gripper cylinder according to claim 1, wherein the adjusting means includes a disk rotatably mounted on the cylinder shaft at one end of the cylinder body, the disk being operatively connected to the grippers so that rotation of the disk causes movement of the grippers, the adjusting means further including a member fixed to the cylinder shaft and a threaded spindle connected to the fixed member and the disk so that rotation of the spindle causes rotation of the disk relative to the fixed member.

14. A gripper cylinder according to claim 1, wherein the adjusting means includes a disk rotatably mounted on the cylinder shaft at one end of the cylinder body, the disk being operatively connected to the gripper bases so that rotation of the disk causes movement of the gripper bases, the adjusting means further including a member fixed to the cylinder shaft and a threaded spindle connected to the fixed member and the disk so that rotation of the spindle causes rotation of the disk relative to the fixed member.

15. A gripper cylinder according to claim 1, and further comprising resilient inserts mounted in the gripper bases.

* * * * *